US012502594B2

(12) United States Patent
Dutaut et al.

(10) Patent No.: US 12,502,594 B2
(45) Date of Patent: Dec. 23, 2025

(54) ALPINE SKI WITH IMPROVED SIDECUT

(71) Applicants: Jean-Luc Dutaut, La Ravoire (FR); Pierre Billon, Saint Jean de Moirans (FR); Romain Bailly, Coublevie (FR)

(72) Inventors: Jean-Luc Dutaut, La Ravoire (FR); Pierre Billon, Saint Jean de Moirans (FR); Romain Bailly, Coublevie (FR)

(73) Assignee: SKIS ROSSIGNOL, Saint-Jean de Moirans (FR)

( * ) Notice: Subject to any disclaimer, the term of this patent is extended or adjusted under 35 U.S.C. 154(b) by 228 days.

(21) Appl. No.: 18/223,645

(22) Filed: Jul. 19, 2023

(65) Prior Publication Data

US 2024/0024758 A1 Jan. 25, 2024

(30) Foreign Application Priority Data

Jul. 20, 2022 (FR) ..... 2207412

(51) Int. Cl.
*A63C 5/04* (2006.01)
*A63C 5/052* (2006.01)

(52) U.S. Cl.
CPC ..... *A63C 5/0405* (2013.01); *A63C 5/052* (2013.01)

(58) Field of Classification Search
CPC ..... A63C 5/0405; A63C 5/052; A63C 5/0434
See application file for complete search history.

(56) References Cited

U.S. PATENT DOCUMENTS 6,102,428 A * 8/2000 Bobrowicz ..... A63C 5/0405 280/607
8,783,707 B2 * 7/2014 Reguis ..... A63C 5/03 280/14.22
8,919,790 B2 * 12/2014 Reguis ..... A63C 5/0405 441/68

FOREIGN PATENT DOCUMENTS

EP 1100598 B1 * 12/2003 ..... A63C 5/0405
EP 1925344 A1 5/2008
EP 2082787 A1 * 7/2009 ..... A63C 5/006
EP 2147703 A1 1/2010
EP 2617475 A1 7/2013
FR 2465500 A1 * 3/1981 ..... A63C 5/031
FR 2612792 A1 * 9/1988 ..... A63C 5/03
FR 2985914 A1 7/2013

OTHER PUBLICATIONS

EP-2082787-A1 English Translation (Year: 2009).*
FR-2612792-A1 English Translation (Year: 1988).*
FR-2465500-A1 English Translation (Year: 1981).*
EP-1100598-B1 English Translation (Year: 2003).*
International Standard, ISO 6289:2003(E/F), Technical Corrigendum 1, XP-002425472, May 19, 2006 (34 pages).
French Search Report for corresponding French Application No. 2207412 dated Mar. 13, 2023 (7 pages).

* cited by examiner

*Primary Examiner* — Michael T. Walsh
(74) *Attorney, Agent, or Firm* — Harris Beach Murtha Cullina PLLC

(57) ABSTRACT

The present invention relates to an alpine ski including a tip zone located at the front of the ski, a waist zone, and a tail zone located at the rear of the ski, a median longitudinal plane extending from the front end to the rear end of the ski, an underside formed by a gliding sole bordered by edges, a zone for mounting a boot. The alpine ski further defined by (Continued)

a radius of curvature measured along the sidecut of the alpine ski.

11 Claims, 3 Drawing Sheets

ALPINE SKI WITH IMPROVED SIDECUT

CROSS-REFERENCE TO RELATED APPLICATIONS

This application claims priority to, and the benefit of French Application No. 2207412 filed on Jul. 20, 2022, which is incorporated herein by reference in its entirety.

TECHNICAL FIELD

The invention relates to the field of boards for gliding over snow, and in particular alpine skis.

It is more particularly directed at an alpine ski having a particular sidecut, providing it with specific properties in terms of behavior on snow, in particular for advanced practices in racing.

PRIOR ART

In general, an alpine ski has different zones distributed over its length, namely a tip zone located at the front and curved upwards to overcome obstacles, a tail zone, located at the rear of the ski and also slightly raised, as well as a waist zone extending between the tail and the tip. The waist ensures that the ski glides by its underside, formed of a gliding sole bordered by edges, and receiving the mounting elements of the safety binding on the topside.

In general, although not mandatory, skis are symmetrical with respect to their median longitudinal plane, which extends from the front end to the rear end of the ski. The sidecut is defined as the line that represents the lateral contour of the ski, which can be more or less deepened.

In a standardized way, a "back contact line" and a "front contact line" are defined on the ski, which are the front and rear limits of the contact surface of the underside when the ski is applied to a flat surface, in particular by loading the ski at the waist to cancel its camber. Meanwhile, a sidecut is defined between the two widest points of the ski, located at the front and at the rear. There has been a trend towards making alpine skis with the widest point beyond the front contact line, so that the ski widens a little in the tip section before arriving at the front tip of the ski. The same trend is observed for the rear part of the ski, with a line of greater rear width, which can be located further back than the rear contact line, even inside the tail zone.

Many solutions have been proposed to produce particular behaviors when steering the ski, by ensuring a more or less significant deepening of the sidecut.

Conventionally, skis are designed to have a sidecut in the waist zone that lies on a circle, so that the radius of curvature of the sidecut is generally constant over the entire waist, with a well-localized center of curvature, resulting in curves substantially centered on this point. Other solutions have been proposed to ensure a progression or variation of the radius of curvature along the sidecut, such as that illustrated in the Applicant's document FR2985914. The curvature of the sidecut of the ski described herein varies in such a way that it is oriented outwards in the central part of the waist, and oriented towards the inside of the ski in the front and rear zones of the waist up to the tip and tail, respectively. Such a geometry is supposed to ensure a particular distribution of forces along the sidecut, when the ski is tilted on the edge, with a view to making it easier to steer the ski.

This configuration is therefore not necessarily compatible with the quest for performance, especially in ski racing.

DESCRIPTION OF THE INVENTION

To solve this problem, the invention proposes an alpine ski comprising a tip zone located at the front of the ski, a waist zone, and a tail zone located at the rear of the ski, a median longitudinal plane extending from the front end to the rear end of the ski, an underside formed by a gliding sole bordered by edges. Classically, this ski features a binding mounting zone, the position of which is determined by a "mounting point" ($P_M$), as defined in ISO 6289 and ISO 5355. This mounting point is intended to be aligned longitudinally with a mark on the boot held by the binding, which is located at a mid-boot line ($M_C$). In the following, the mounting point and the mid-shoe line are assumed to be at the same longitudinal level and are therefore to be considered as identical.

The sidecut of this ski has:

- a front contact line ($P_A$) defined as the contact line between the gliding sole and a horizontal surface on which the sole is pressed when the waist is loaded, which is located furthest forward,
- a rear contact line ($P_B$) defined as the contact line between the gliding sole and said horizontal surface, which is located furthest rearward,
- a line of stronger front width ($P_I$) located at or further forward than the front contact line ($P_A$),
- a line of greater rear width ($P_{II}$), located at or further back than the line of rear contact ($P_B$),
- a zone of minimum width ($P_{III}$) located in the waist zone.

said sidecut having a variable radius of curvature between the front contact line ($P_A$) and the rear contact line ($P_B$), According to one aspect of the invention, this ski is characterized in that the width of the ski, measured perpendicular to the median longitudinal plane, at the front contact line ($P_A$) is strictly less than the width of the ski measured at the rear contact line ($P_B$).

In other words, the width of the ski at the border between the waist and the tail is greater than the same width measured at the border between the waist and the tip. In other words, the width of the gliding zone is greater behind than in front of the waist zone.

Additionally, the zone of minimum width ($P_{III}$) of the ski is located further forward than the mid-boot line ($M_C$).

Advantageously in practice, the distance between the width at the front contact line ($P_A$) and the width at the rear contact line ($P_B$) is between 2 and 10 mm.

In preferred embodiments, the distance between the zone of minimum width ($P_{III}$) and the mid-shoe line ($M_C$) is greater than 2 mm, preferably 5 mm, and less than or equal to 100 mm.

According to another aspect of the invention, the radius of curvature has a maximum value at a transverse line located strictly between the front contact line ($P_A$) and the rear contact line ($P_B$), And the ratio between the maximum radius of curvature value and the value of the radius of curvature at the front contact line is greater than 2.5, preferably greater than 3.

In other words, the invention consists in providing the ski with a particular geometry in which the radius of curvature is highly variable between the front contact line and the rear contact line, with a very marked maximum, i.e., a relatively low curvature in this zone, compared to the curvature measured near the tail and the tip.

In other words, the ski according to the invention has a relatively straight sidecut in the zone where the boot is fitted, whereas closer to the front and back contact lines, i.e., at the ends of the waist, the curvature is more pronounced, ensuring the deepening of the sidecut. Advantageously in practice, it has been found that the ski's behavior is all the more effective and advantageous in racing, while maintaining a ski that is tolerant of terrain imperfections, when the ratio between the value of the maximum radius of curvature and the greater of the two radii of curvature at the front and rear contact lines is greater than 2.5. This ratio can be even higher, in excess of 3, or even 4 for advanced racing skis. In other words, a particularly interesting geometry is one in which the difference between the very large radius of curvature at the center of the waist zone and the larger of the relatively small radii of curvature at the front or rear contact line is the greatest.

At the same time, the Applicant has observed that this geometry is particularly advantageous when the line of the middle of the boot is located slightly set back with respect to the narrowest zone of the ski. In other words, the narrow point of the ski is located forward of the mid-boot mark. The ski's behavior is further improved by the fact that the very low-curvature region is therefore located in front of the mid-boot line, notably for ease of initiating the turn and entering a curve.

According to another feature of the invention, the variation of the radius of curvature of the sidecut according to the longitudinal position of the measuring point is a function whose second derivative with respect to said longitudinal position is positive for a longitudinal position between the rear contact line and the front contact line.

In other words, the measurement of the radius of curvature along the sidecut is such that its increase increases as it moves from the rear contact point towards the maximum. And this decrease also increases from its maximum to the front contact point. In other words, the variation in radius of curvature increases from the point of rear contact to the point of minimum curvature, and this same variation diminishes from this maximum to the vicinity of the front contact line.

Advantageously in practice, the transverse line where the radius of curvature is maximum is located approximately at the narrowest point of the ski ($P_{III}$). In other words, the narrow point of the ski corresponds roughly, within 5 millimeters, to the point where the curvature is smallest, and where the sidecut is closest to a straight profile.

BRIEF DESCRIPTION OF THE FIGURES

The invention will be well understood, and its advantages and various other characteristics will become apparent, in the light of the following description of a few non-limiting exemplary embodiments, with reference to the appended schematic drawings, in which.

Of course, the illustrations provided in the figures are schematic only, and certain proportions may differ from reality, for the sake of a better understanding of the invention.

DESCRIPTION OF EMBODIMENTS

For greater clarity, we define an Oxyz reference frame and xy, yx, and xz planes defined by the non-collinear x, y, and z vectors of the Oxyz reference frame. For greater simplicity, it will be considered that the forward direction corresponds to the longitudinal direction of the ski along the Ox axis, oriented from the waist towards the tip.

Generally speaking, a ski has dimensional parameters defined in accordance with ISO 62 89.

Figure 1:
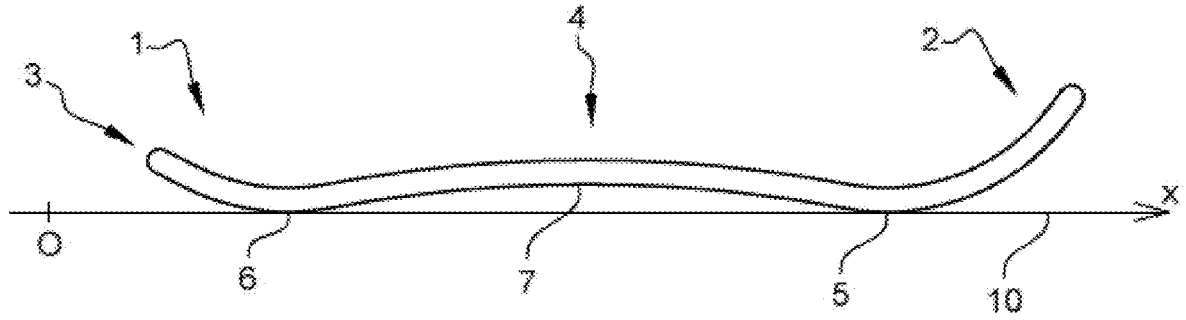
FIG. 1 is a schematic side view of a ski according to the invention, shown unloaded.

Thus, as illustrated in FIG. 1, the ski 1 has a tip zone 2 at the front and a tail zone 3 at the rear separated by the central zone 4, also referred to as the waist zone. When the ski 1 is placed on a horizontal plane 10, without being loaded, the camber it presents in the waist zone brings it into contact with this horizontal plane at two specific points 5; 6 front and back.

Figure 2:
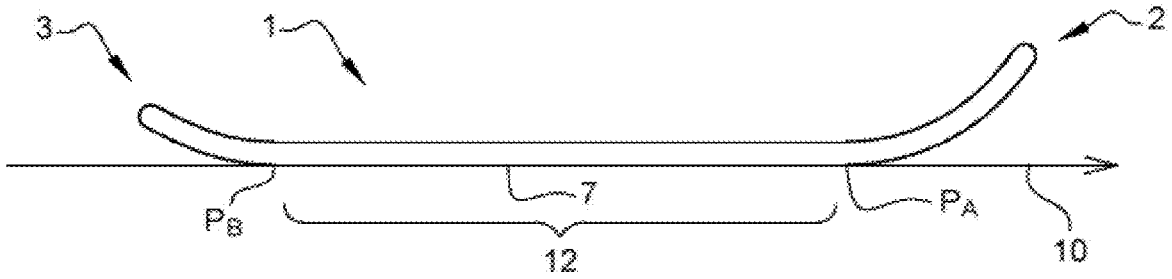
FIG. 2 is a side view of the ski of FIG. 1, shown loaded, with its underside pressed against a horizontal surface.

As illustrated in FIG. 2, when this ski 1 is loaded, i.e., when it is subjected to the weight of a user such that the camber of the waist zone 4 is counteracted, the gliding sole comes into contact with the horizontal plane 10 on a glide zone. This gliding zone 12 defined between two specific lines which are the front contact line $P_A$, marking the rear border of the tip 2, and the rear contact line $P_B$ forming the front border of the tail zone 3.

Figure 3:
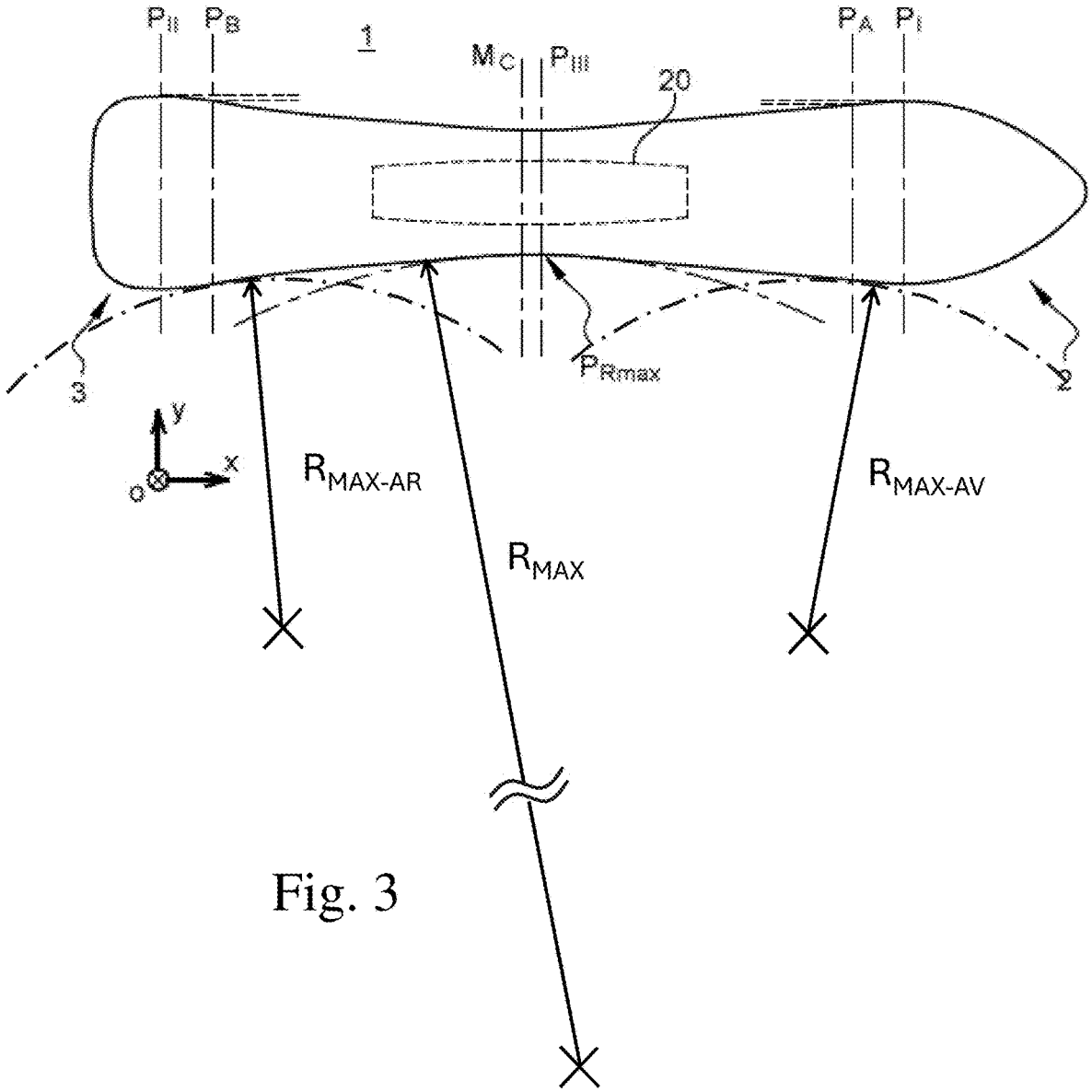
FIG. 3 is a schematic top view of the ski in FIGS. 1 and 2, showing the various dimensional parameters characteristic of the invention.

Additionally, and as illustrated in FIG. 3, the ski 1 has a width which is variable from the tail 3 to the tip 2. This width, measured perpendicular to the median longitudinal plane along the Oy axis, has localized extremes. Thus, in the tail zone 3, the ski 1 has a maximum width at the point $P_{II}$. In the embodiment illustrated in the figures, it should be noted that this point $P_{II}$ is behind the point $P_B$ corresponding to the rear contact line. On the other side of the ski, the latter has a maximum width at point $P_I$, at a level located further forward than the front contact line $P_A$.

The ski also has a minimum width in the waist zone, at point $P_{III}$.

In some cases, the Applicant has found that a particular behavior can be observed when the ski width at the $P_B$ point of the ski, at the rear contact line, near the tail zone, is greater than the ski width at the $P_A$ point of the ski, at the front contact line, near the tip zone. More specifically, this difference in width ($LP_B$–$LP_A$) can be between 2 to 10 millimeters and leads to a snow behavior that favors ski pivoting and is more tolerant of terrain imperfections.

As shown in FIG. 3, the ski has a zone in which the safety binding is designed to be fitted, to accommodate the user's boot. This zone is materialized by the dotted region 20 in FIG. 3, and essentially defined by the line $M_C$ corresponding to the mid-shoe. In particular, this point $M_C$ makes it possible to position the tail and toe of the binding symmetrically, relative to this point $M_C$, to take account of the user's shoe size, or the implementation of a platform in which the toe and tail of the binding are adjustable in position.

The Applicant has observed the advantage of a configuration in which the zone of minimum width $P_{III}$ is located further forward than the mid-shoe line $M_C$. In particular, this difference can be greater than 2 mm, or even greater than 5 mm, and preferably between 5 and 15 mm.

This parameter facilitates ski entry into the curve at the start of a turn.

Figure 4:
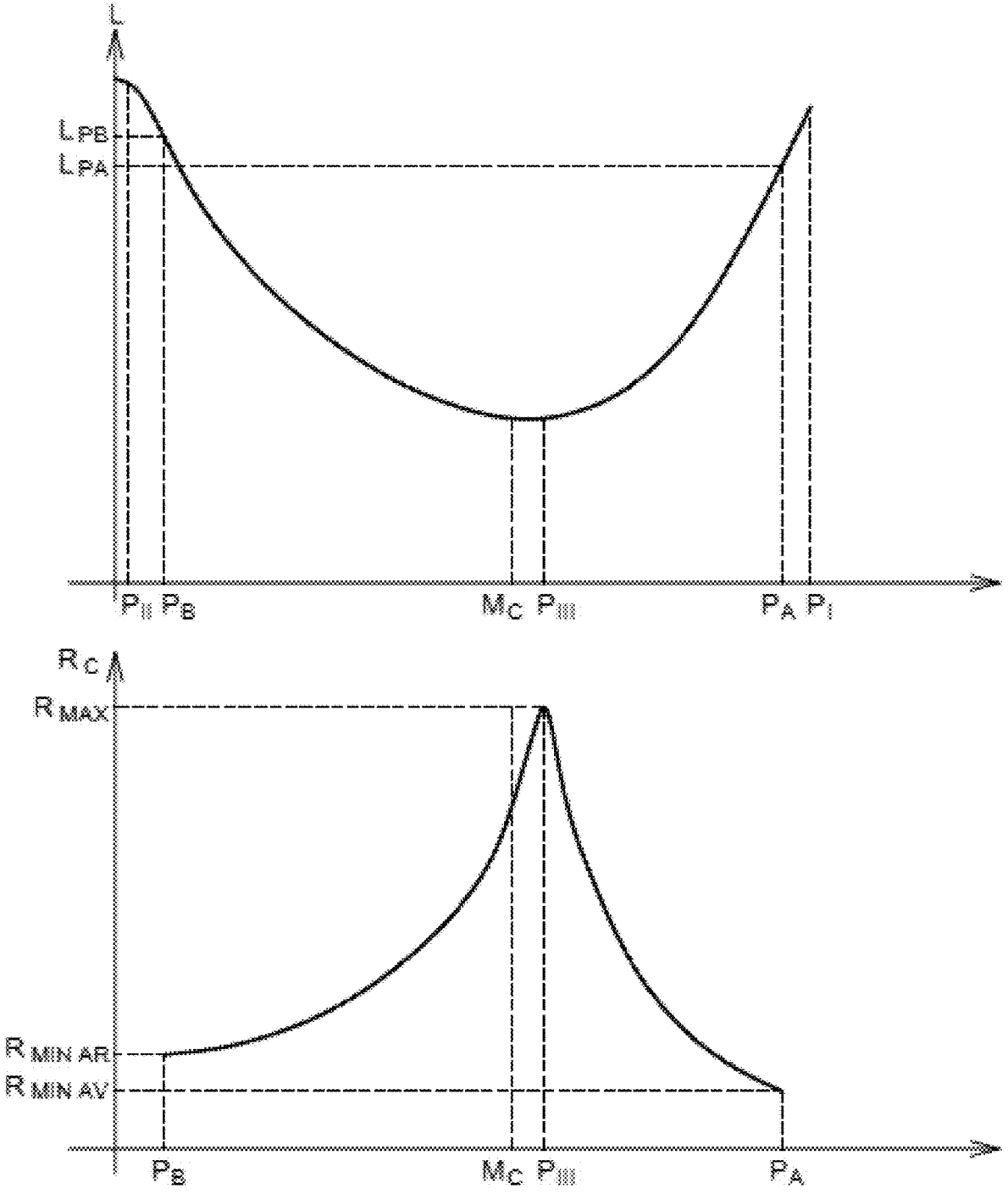
FIG. 4 is a diagram illustrating the variation of width measured along the ski of FIG. 3, as well as the variation of the radius of curvature.

The skis according to the invention have a particular geometry, especially with regard to the radius of curvature $R_C$ of the sidecut. In practice, this radius of curvature can be measured from the variation in the width of the ski, measured in the longitudinal direction Ox. Thus, from a ski width profile reading along the Ox axis, it is possible to calculate the curvature, and the radius of curvature (which is the inverse of the curvature) to produce a curve as shown in FIG. 4. More precisely, the second derivative of the ski width curve is used to obtain the curve giving the curvature of the ski along the sidecut. Of course, other practical methods can be implemented to calculate this radius of curvature, in particular by using mechanical devices which are moved along the sidecut. By approximating the measured sidecut with a polynomial of degree three, for example, it is possible to obtain the curve of the radius of curvature along the ski by deriving this polynomial twice. Using empirical calculations based on the coordinates of three gliding points moving along the sidecut, it is also possible to calculate the radius of curvature.

In accordance with the invention, the radius of curvature has a specific variation so that it has a maximum value $R_{MAX}$ located close to, or even coincident with, the point of least width $P_{III}$. The value of the maximum radius of curvature is particularly high, greater than 35 m, or even 50 m, preferably between 50 and 80 m. In particular, this maximum value can be used to adjust the ski's degree of grip.

In addition thereto, and as illustrated in FIG. 3, the radius of curvature is significantly smaller as one moves towards the ends of the ski. St the ends of the ski, at points $P_A$ and $P_B$, the radii of curvature are between 5 and 20 m, preferably between 10 and 20 m.

It can be seen in FIG. 4 that the minimum values of the radius of curvature at the front $R_{MAX\text{-}AV}$ and at the rear $R_{MAX\text{-}AR}$ are much lower than the value of the maximum radius $R_{MAX}$, in a ratio of at least 2.5 or even preferably greater than 3, even 4.

In addition thereto, the evolution of the radius of curvature is also specific to skis conforming to the invention, since as can be seen in FIG. 4, the second derivative of the radius of curvature calculated along the $O_X$ axis is such that it is always positive, meaning that the closer you get to the point where the radius of curvature is maximum, the faster this radius of curvature increases.

The geometry of the skis according to the invention is particularly advantageous for its performance qualities on snow while remaining easy. More precisely, these skis offer an ease of entry into turns, a distribution of the support pressure across the entire length of the ski which allows avoiding points of over-gripping. Such skis have a narrower tip, which is easier to handle because it doesn't produce accidental gripping at the front.

The invention claimed is:

1. Alpine ski comprising a tip zone located at the front of the ski, a waist zone, and a tail zone located at the rear of the ski, a median longitudinal plane extending from the front end to the rear end of the ski, an underside formed by a gliding sole bordered by edges, a zone for mounting a boot, the middle of which, in the longitudinal direction, is located at a mid-shoe line ($M_C$), and having a sidecut with:

a front contact line ($P_A$) defined as the line of contact between the gliding sole and a horizontal surface against which the sole is pressed when the waist is loaded, which is located furthest forward, the front contact line ($P_A$) forming the rear border of the tip zone, a rear contact line ($P_B$) defined as the line of contact between the gliding sole and said horizontal surface, which is located furthest back, the rear contact line ($P_B$) forming the front border of the tail zone, a line of greater front width ($P_I$) located at or further forward than the front contact line ($P_A$), a line of greater rear width ($P_{II}$), located at or more rear than the rear contact line ($P_B$), a zone of minimum width ($P_{III}$) located in the waist zone, said sidecut having a variable radius of curvature between the front contact line ($P_A$) and the rear contact line ($P_B$), wherein the width of the ski, measured perpendicular to the median longitudinal plane, at the front contact line ($P_A$) is strictly less than the width of the ski measured at the rear contact line ($P_B$) and in that the zone of minimum width (PMI) is further forward than the mid-shoe line ($M_C$).

2. Alpine ski according to claim 1, wherein the difference between the width at the front contact line ($P_A$) and the width at the rear contact line ($P_B$) is between 2 and 10 mm.

3. Alpine ski according to claim 1, wherein the distance between the zone of minimum width ($P_{III}$) and the mid-shoe line ($M_C$) is greater than 2 mm.

4. Alpine ski according to claim 1, wherein the distance between the zone of minimum width ($P_{III}$) and the mid-shoe line ($M_C$) is lower or equal to 100 mm.

5. Alpine ski according to claim 1, wherein the radius of curvature has a maximum value ($R_{MAX}$) at a transverse line located strictly between the front contact line ($P_A$) and the rear contact line ($P_B$), in that the ratio between the value of the maximum radius of curvature ($R_{MAX}$) and the value of the radius of curvature at the front contact line is greater than 2.5.

6. Alpine ski according to claim 5, wherein the ratio between the value of the maximum radius of curvature ($R_{MAX}$) and the greater of the two radii of curvature ($R_{MAX\text{-}AV}$, $R_{MAX\text{-}AR}$) at the front and rear contact lines is greater than 4.

7. Alpine ski according to claim 5, wherein the maximum radius of curvature ($R_{MAX}$) is greater than 35 m.

8. Alpine ski according to claim 1, wherein the variation of the radius of curvature ($R_c$) of the sidecut according to the longitudinal position of the measuring point is a function whose second derivative with respect to said longitudinal position is positive for a longitudinal position between the rear contact line ($P_B$) and the front contact line ($P_A$).

9. Alpine ski according to claim 1, wherein the transverse line where the radius of curvature is maximum is located approximately at the narrowest point of the ski ($P_{III}$).

10. Alpine ski according to claim 1, wherein the distance between the zone of minimum width ($P_{III}$) and the mid-shoe line ($M_C$) is greater than 5 mm.

11. Alpine ski according to claim 1, wherein the radius of curvature has a maximum value ($R_{MAX}$) at a transverse line located strictly between the front contact line ($P_A$) and the rear contact line ($P_B$), in that the ratio between the value of the maximum radius of curvature ($R_{MAX}$) and the value of the radius of curvature at the front contact line is greater than 3.

* * * * *